United States Patent [19]

Gorzegno et al.

[11] Patent Number: 5,069,170

[45] Date of Patent: Dec. 3, 1991

[54] FLUIDIZED BED COMBUSTION SYSTEM AND METHOD HAVING AN INTEGRAL RECYCLE HEAT EXCHANGER WITH INLET AND OUTLET CHAMBERS

[75] Inventors: Walter P. Gorzegno, Morristown; Iqbal F. Abdulally, Randolph; John W. Phalen, Somerville; Alfred S. Touma, West Caldwell, all of N.J.

[73] Assignee: Foster Wheeler Energy Corporation, Clinton, N.J.

[21] Appl. No.: 486,652

[22] Filed: Mar. 1, 1990

[51] Int. Cl.[5] ..... B09B 3/00; F22B 1/00

[52] U.S. Cl. ..... 122/4 D; 110/245; 165/104.16; 422/146

[58] Field of Search ..... 122/4 D; 110/245; 165/104.16; 422/146

[56] References Cited

U.S. PATENT DOCUMENTS

| | | | |
|---|---|---|---|
| 3,893,426 | 7/1975 | Bryers . | |
| 4,111,158 | 9/1978 | Reh et al. . | |
| 4,165,717 | 8/1979 | Reh et al. . | |
| 4,227,488 | 10/1980 | Stewart et al. . | |
| 4,338,283 | 7/1982 | Sakamoto et al. . | |
| 4,469,050 | 9/1984 | Korenberg . | |
| 4,594,967 | 6/1986 | Wolowodiuk . | |
| 4,617,877 | 10/1986 | Gamble . | |
| 4,665,864 | 5/1987 | Seshamani et al. . | |
| 4,682,567 | 7/1987 | Garcia-Mallol et al. . | |
| 4,686,939 | 8/1987 | Stromberg . | |
| 4,694,758 | 9/1987 | Gorzegno et al. . | |
| 4,704,084 | 11/1987 | Liu et al. . | |
| 4,709,662 | 12/1987 | Randon | 122/4 D |
| 4,716,856 | 1/1988 | Beisswenger et al. | 122/4 D |
| 4,761,131 | 8/1988 | Abdulally . | |
| 4,813,479 | 3/1989 | Wahlgren | 122/4 D X |
| 4,856,460 | 8/1989 | Wied et al. . | |
| 4,896,717 | 1/1990 | Campbell, Jr. et al. . | |
| 4,947,804 | 8/1990 | Abdulally . | |
| 4,969,930 | 11/1990 | Arpalahti . | |

*Primary Examiner*—Edward G. Favors

*Attorney, Agent, or Firm*—Marvin A. Naigur

[57] ABSTRACT

A fluidized bed combustion system and method in which a recycle heat exchange section is located within an enclosure housing the furnace section of the combustion system. The flue gases and entrained solids from a fluidized bed in the furnace section are separated and the flue gases are passed to a heat recovery section and the separated particulate material to the recycle heat exchange section. The recycle heat exchange section includes a bypass chamber for permitting the separated solids to pass directly from the separator to the furnace section. A heat exchange is provided in the recycle heat exchange section to transfer heat from the separated material in the recycle heat exchange section to a fluid flow circuit for heating the fluid flow circuit and reducing the temperature of the separated material. The separated material of the recycle heat exchange section is then passed back to the furnace section.

35 Claims, 2 Drawing Sheets

FLUIDIZED BED COMBUSTION SYSTEM AND METHOD HAVING AN INTEGRAL RECYCLE HEAT EXCHANGER WITH INLET AND OUTLET CHAMBERS

BACKGROUND OF THE INVENTION

This invention relates to a fluidized bed combustion system and a method of operating same and, more particularly, to such a system and method in which a recycle heat exchanger is formed integrally with the furnace section of the system.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

The most typical fluidized bed utilized in the furnace section of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The high external solids recycling is achieved by disposing a cyclone separator at the furnace section outlet to receive the flue gases, and the solids entrained thereby, from the fluidized bed. The solids are separated from the flue gases in the separator and the flue gases are passed to a heat recovery area while the solids are recycled back to the furnace through a seal pot, or "J" type "L" type or any other similar type of seal valve. This recycling improves the efficiency of the separator, and the resulting increase in the efficient use of sulfur adsorbent and fuel residence times reduces the adsorbent and fuel consumption.

In the operation of these types of fluidized beds, and, more particularly, those of the circulating type, there are several important considerations. For example, the flue gases and entrained solids must be maintained in the furnace section at a substantially isothermal temperature (usually approximately 1600° F.) consistent with proper sulfur capture by the adsorbent. As a result, the maximum heat capacity (head) of the flue gases passed to the heat recovery area and the maximum heat capacity of the separated solids recycled through the cyclone and to the furnace section are limited by this temperature. In a cycle not requiring reheat duty, the heat content of the flue gases at the furnace section outlet is usually sufficient to provide the necessary heat for use in the heat recovery area of the steam generator downstream of the separator. Therefore, the heat content of the recycled solids is not needed.

However, in a steam generator using a circulating fluidized bed with sulfur capture and a cycle that requires reheat duty as well as superheater duty, the existing heat available in the flue gases at the furnace section outlet is not sufficient. At the same time, heat in the furnace cyclone recycle loop is in excess of the steam generator duty requirements. For such a cycle, the design must be such that the heat in the recycled solids must be utilized before the solids are reintroduced to the furnace section.

To provide this extra heat capacity, a recycle heat exchanger is sometimes located between the separator solids outlet and the fluidized bed of the furnace section. The recycle heat exchanger includes superheater heat exchange surface and receives the separated solids from the separator and functions to transfer heat from the solids to the superheater surfaces at relatively high heat transfer rates before the solids are reintroduced to the furnace section. The simplest technique for controlling the amount of heat transfer in the recycle heat exchanger is to vary the level of solids therein. However, situations exist in which a sufficient degree of freedom in choosing the recycle bed height is not available, such as for example, when a minimum fluidized bed solids depth or pressure is required for reasons unrelated to heat transfer. In this case, the heat transfer may be controlled by utilizing "plug valves" or "L valves" for diverting a portion of the recycled solids so that they do not contact and become cooled by the recycle heat exchanger. The solids from the diverting path and from the heat exchanger path are recombined or each stream is directly routed to the furnace section to complete the recycle path. In this manner, the proper transfer of heat to the heat exchanger surface is achieved for the unit load existing. However, these type arrangements require the use of moving parts within the solids system and/or need external solids flow conduits with associated aeration equipment which adds considerable cost to the system.

In order to reduce these costs, a system has been devised that is disclosed in U.S. application Ser. No. 371,170 filed on June 26, 1989 by the assignee of the present invention. According to this system a recycle heat exchanger is provided for receiving the separated solids and distributing them back to the fluidized bed in the furnace section. The recycle heat exchanger is located externally of the furnace section of the system and includes an inlet chamber for receiving the solids discharged from the separators. Two additional chambers are provided which receive the solids from the inlet chamber. The solids are fluidized in the additional chambers and heat exchange surfaces are provided in one of the additional chambers for extracting heat from the solids. The solids in the additional chamber are permitted to flow into an outlet chamber when the level in the former chamber exceeds a predetermined height set by the height of an overflow weir. The solids entering the outlet chamber are then discharged back to the fluidized bed in the furnace section.

However, there are some disadvantages associated with this type of operation. For example, the space available for heat exchanger surfaces is limited, and pressure fluctuations in the furnace section are transmitted to the external heat exchanger which results in erratic performance. Also, the solids are directed from the heat exchanger to one relatively small area of the furnace section which is inconsistent with uniform mixing and distribution of the solids. Further, this system relies on pressure differential to drive the solids from the heat exchanger to the furnace section which requires power.

SUMMARY OF THE INVENTION

It is an object of the present invention to provide a fluidized bed combustion system and method which utilizes a recycle heat exchanger disposed integrally with the furnace section of the combustion system in which heat is removed from the separated solids before they are recycled back to the furnace.

It is a further object of the present invention to provide a system and method of the above type in which the heat removed from the separated solids in the recycle heat exchanger is used to provide the desired furnace temperature.

It is a further object of the present invention to provide a system and method of the above type in which heat is removed from the separated solids without reducing the temperature of the flue gases.

It is a further object of the present invention to provide a system and method of the above type in which the heat removed from the separated solids in the recycle heat exchanger is transferred to fluid circulating in a heat exchange relation with the combustion system.

It is a further object of the present invention to provide a system and method of the above type in which the need for heat exchange surfaces in the heat recovery area of the combustion system is reduced.

It is a still further object of the present invention to provide a system and method of the above type in which the recycle heat exchanger includes a direct bypass for routing the separated solids directly and uniformly to the furnace section without passing over any heat exchange surfaces, during start-up, shut-down, unit trip, and low load conditions.

It is a still further object of the present invention to provide a system and method of the above type in which the recycle heat exchanger includes heat exchanger surfaces disposed between transverse inlet and outlet chambers to insure a uniform distribution of the separated solids through the recycle heat exchanger to increase the heat exchange efficiency and insure a uniform discharge of solids to the furnace.

It is a still further object of the present invention to provide a system and method of the above type in which the recycle heat exchanger is isolated from pressure fluctuations in the furnace.

It is a still further object of the present invention to provide a system and method of the above type in which the solids are driven from the recycle heat exchanger to the furnace by height differentials.

It is a still further object of the present invention to provide a system and method of the above type in which a relatively large space is available for the recycle heat exchanger surfaces.

Toward the fulfillment of these and other objects, the system of the present invention includes a recycle heat exchanger located adjacent the furnace section of the system. The flue gases and entrained particulate materials from the fluidized bed in the furnace section are separated, the flue gases are passed to a heat recovery area and the separated solids are passed to the recycle heat exchanger for transferring heat from the solids to fluid passing through the system. Heat exchange surfaces are provided in the heat exchanger for removing heat from the solids and a bypass passage is provided through which the solids pass during start-up and low load conditions. Transverse inlet and outlet channels are provided in the heat exchanger for providing a uniform distribution of the separated solids through the heat exchanger and a uniform flow of solids to the furnace section. More than one bypass may be used and the location may be varied according to particular design and function requirements.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 2:
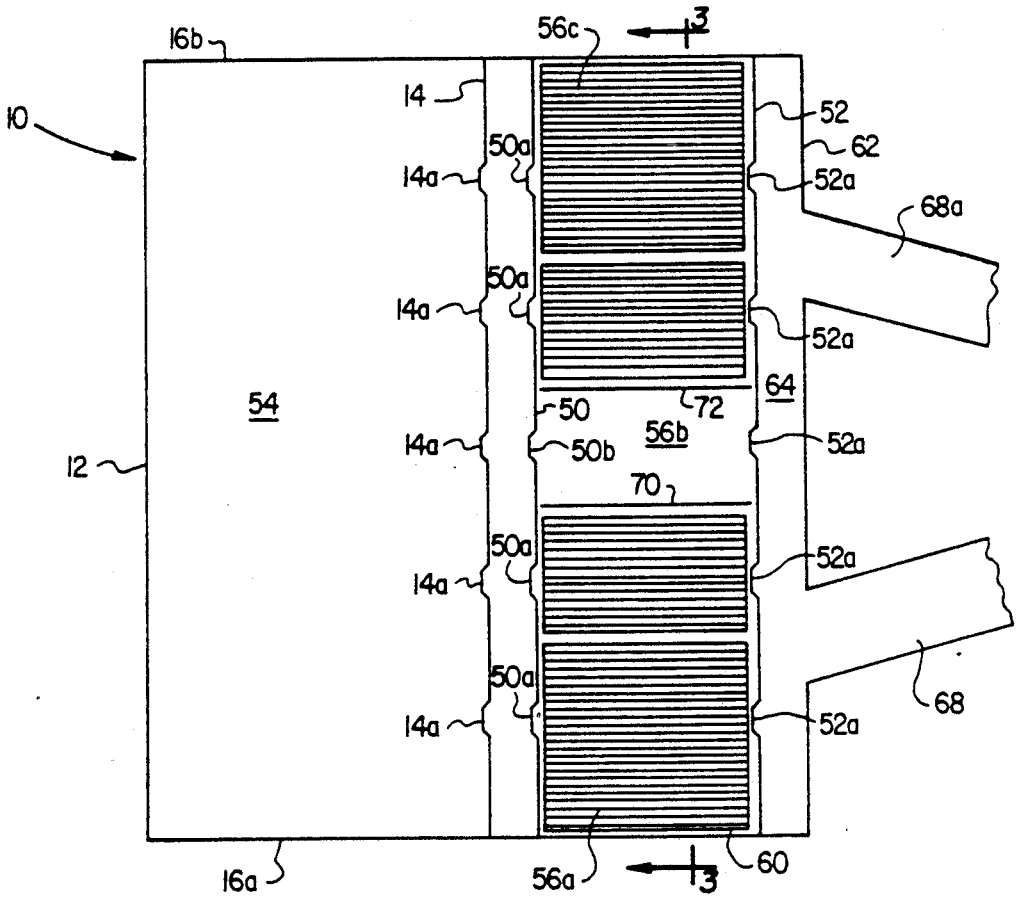
FIG. 2 is a cross-sectional view taken along the line 213 2 of FIG. 1.
Figure 3:
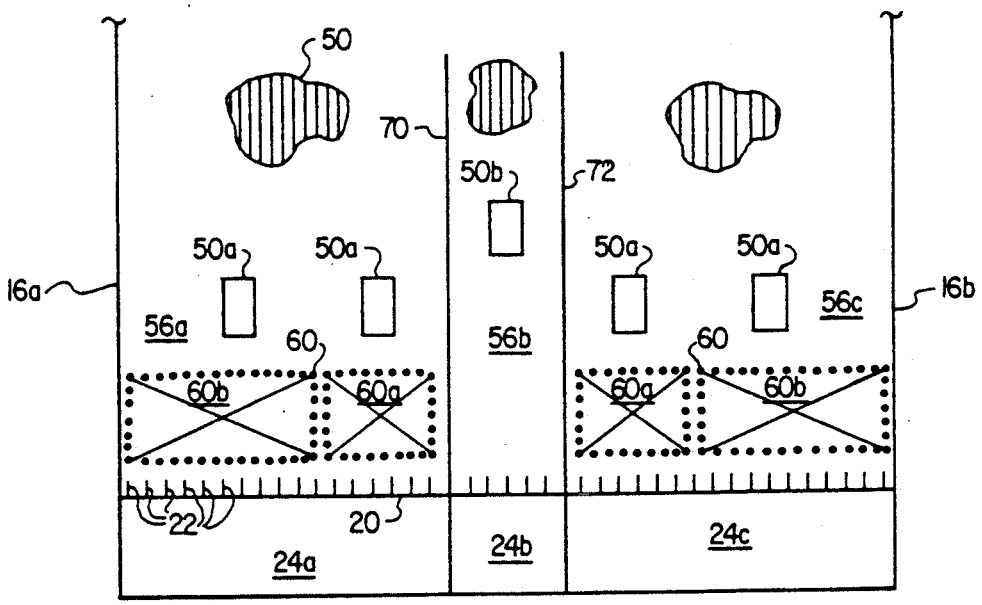
FIG. 3 is a cross-sectional view taken along the line 3—3 of FIG. 2.

The drawings depict the fluidized bed combustion system of the present invention used for the generation of steam and including an upright water-cooled enclosure, referred to in general by the reference numeral 10, having a front wall 12, a rear wall 14 and two sidewalls 16*a* and 16*b* (FIGS. 2 and 3). The upper portion of the enclosure 10 is enclosed by a roof 17 and the lower portion includes a floor 18.

A plurality of air distributor nozzles 20 are mounted in corresponding openings found in a plate 22 extending across the lower portion of the enclosure 10. The plate 22 is spaced from the floor 18 to define an air plenum 24 which is adapted to receive air from external sources (not shown) and selectively distribute the air through the plate 22 and to portions of the enclosure 10, as will be described.

A coal feeder system, shown in general by the reference numeral 25, is provided adjacent the front wall 12 for introducing particulate material containing fuel into the enclosure 10. The particulate material is fluidized by the air from the plenum 24 as it passes upwardly through the plate 22. This air promotes the combustion of the fuel and the resulting mixture of combustion gases and the air (hereinafter termed "flue gases") rises in the enclosure by forced convection and entrains a portion of the solids to form a column of decreasing solids density in the upright enclosure 10 to a given elevation, above which the density remains substantially constant.

A cyclone separator 26 extends adjacent the enclosure 10 and is connected thereto via a duct 28 extending from an outlet provided in the rear wall 14 of the enclosure 10 to an inlet provided through the separator wall. Although reference is made to one separator 26, it is understood that one or more additional separators (not shown) may be disposed behind the separator 26. The number and size of separators used is determined by the capacity of the steam generator and economic considerations.

The separator 26 receives the flue gases and the entrained particle material from the enclosure 10 in a manner to be described and operates in a conventional manner to disengage the particulate material from the flue gases due to the centrifugal forces created in the separator. The separated flue gases, which are substantially free of solids, pass, via a duct 30 located immediately above the separator 26, into a heat recovery section shown in general by the reference numeral 32.

The heat recovery section 32 includes an enclosure 34 divided by a vertical partition 35 into a first passage which houses a reheater 36, and a second passage which houses a primary superheater 37 and an economizer 38, all of which are formed by a plurality of heat exchange tubes extending in the path of the gases from the separator 26 as they pass through the enclosure 34. An opening 35*a* is provided in the upper portion of the partition 35 to permit a portion of the gases to flow into the passage containing the superheater 37 and the economizer 38. After passing across the reheater 36, superheater 37 and the economizer 38 in the two parallel passes, the gases exit the enclosure 34 through an outlet 42.

Figure 1:
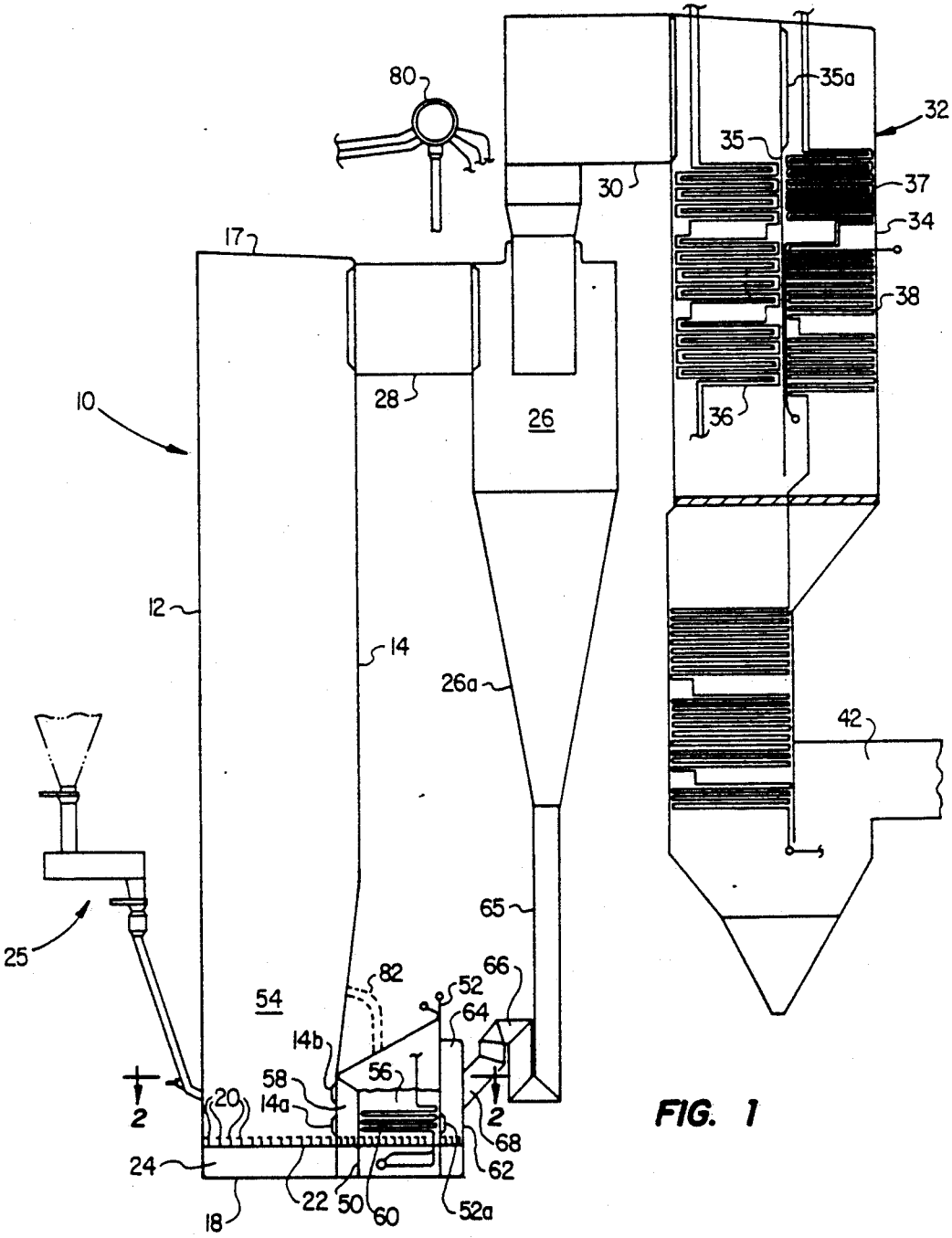
FIG. 1 is a schematic representation depicting the system of the present invention.

As shown in FIG. 1, the floor 18 and the plate 22 are extended past the rear wall 14 and a pair of vertically extending, spaced, parallel partitions 50 and 52 extend upwardly from the floor 18. The upper portion of the partition 50 is bent towards the wall 14 to form a sealed boundary and then towards the partition 52 with its upper end extending adjacent, and slightly bent back from, the latter wall, again forming a sealed boundary. Several openings are provided through the wall 14 and the partitions 50 and 52 to establish flow paths for the solids, as will be described.

The front wall 12 and the rear wall 14 define a furnace section 54, the partitions 50 and 52 define a heat exchanger enclosure 56 and the rear wall 14 and the partition 50 define an outlet chamber 58 for the enclosure 56 which chamber is sealed off at its upper portion by the bent portion of the partition 50. A plurality of heat exchange tubes 60 are disposed in the heat exchanger enclosure 56 and will be described in detail later.

A sub-enclosure 62 is mounted on the outer surface of the partition 52 to define an inlet chamber 64 for the heat exchanger enclosure 56. The floor 18 and the plate 22 extend through the chamber 58, the enclosure 56 and the chamber 64 and the extended portion of the plate 22 contains additional nozzles 20. Thus the plenum 24 also extends underneath the chambers 58 and 64 and the enclosure 56 for introducing air to the nozzles 20 located therein.

The lower portion of the separator 26 includes a hopper 26*a* which is connected to a dip leg 65 connected to the inlet "J" valve, shown in general by the reference numeral 66. The "J" valve 66 functions in a conventional manner to prevent back-flow of solids from the furnace section 54 to the separator 26. An inlet conduit 68 connects the outlet of the "J" valve 66 to the sub-enclosure 62 to transfer the separated solids from the separator 26 to the inlet chamber 64 and the heat exchanger enclosure 56. The reference numeral 68*a* (FIG. 2) refers to the inlet conduit associated with an additional separator disposed behind the separator 26 but not shown in the drawings.

As shown in FIGS. 2 and 3, the heat exchanger enclosure 56 is formed into three compartments 56*a*, 56*b* and 56*c* by a pair of transverse spaced partitions 70 and 72 extending between the partition 52 and the partition 50. The aforementioned heat exchange tubes 60 are shown schematically in FIGS. 2 and 3, and are located in the compartments 56*a* and 56*c* where they are divided into two spaced groups 60*a* and 60*b* to permit the installation of spray attemperation in the space for temperature control of superheat, (not shown). The partitions 70 and 72 also divide the plenum 24 into three sections 24*a*, 24*b* and 24*c* extending immediately below the heat exchanger compartments 56*a*, 56*b* and 56*c*, respectively. It is understood that means, such as dampers, or the like, (not shown) can be provided to selectively distribute air to the individual sections 24*a*, 24*b* and 24*c*.

A plurality of spaced openings 52*a* (FIG. 2) are formed in the lower portion of the partition 52 and a plurality of spaced openings 52*a* (FIGS. 2 and 3) are formed in an intermediate portion of those portions of the partition 50 defining the compartments 56*a* and 56*c*. An opening 50*b* is also formed in that portion of the partition 50 defining the compartment 56*b* and extends at an elevation higher than the openings 52*a* (FIGS. 2 and 3). Five spaced openings 14*a* (FIGS. 1 and 2) are formed in the lower portion of the rear wall and five spaced openings 14*b* (FIG. 1) are provided through the upper portion of the latter wall. Although four openings 50*a*, one opening 50*b*, five openings 52*a* five openings 14*a* and five openings 14*b* are shown in FIGS. 2 and 3 by way of example it is understood that this number can vary in accordance with particular design requirements.

Figure 4:
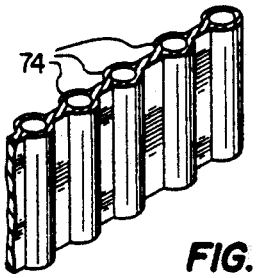
FIG. 4 is a partial, enlarged perspective view of a portion of a wall of the enclosure of the system of FIG. 1.

The front wall 12, the rear wall 14, the sidewalls 16*a* and 16*b*, the partitions 50, 52, 70, and 72, the roof 17, the walls of the sub-enclosure 62 and the walls defining the heat recovery enclosure 34 all are formed of membrane-type walls an example of which is depicted in FIG. 4. As shown, each wall is formed by a plurality of finned tubes 74 disposed in a vertically extending, air tight relationship with adjacent finned tubes being connected along their lengths.

A steam drum 80 is located above the enclosure 10 and, although not shown in the drawings, it is understood that a plurality of headers are disposed at the ends of the various walls described above. Also, a plurality of downcomers, pipes, etc. are utilized to establish a steam and water flow circuit through the tubes 74 forming the aforementioned water tube walls, with connecting feeders, risers, headers and the steam drum 80. The boundary walls of the cyclone separator 26, the heat exchanger tubes 60 and the tubes forming the superheater 37, the reheater 36 are steam cooled while the economizer 38 receives feed water and discharges it to the drum 80. Thus water is passed, in a predetermined sequence through this flow circuitry to convert the water to steam and heat the steam by the heat generated by combustion of the particulate fuel material in the furnace section 54.

In operation, particulate fuel material and a sorbent material (hereinafter referred to as "solids") are introduced into the furnace section 54 through the feeder system 25. Alternately sorbent may also be introduced independently through openings in furnace walls 12, 14, 16*a* and 16*b*. Air from an external source is introduced at a sufficient pressure into that portion of the plenum 24 extending below the furnace section 54 and the air passes through the nozzles 20 disposed in the furnace section 54 at a sufficient quantity and velocity to fluidize the solids in the latter section.

A lightoff burner (not shown), or the like, is provided to ignite the fuel material in the solids, and thereafter the fuel material is self-combusted by the heat in the furnace section. The mixture of air and gaseous products of combustion (hereinafter referred to as "flue gases") passes upwardly through the furnace section 54 and entrains, or elutriates, a majority of the solids. The quantity of the air introduced, via the air plenum 24, through the nozzles 20 and into the interior of the furnace section 54 is established in accordance with the size of the solids so that a circulating fluidized bed is formed, i.e. the solids are fluidized to an extent that substantial entrainment or ellutriation thereof is achieved. Thus the flue gases passing into the upper portion of the furnace section 54 are substantially saturated with the solids and the arrangement is such that the density of the bed is relatively high in the lower portion of the furnace section 54, decreases with height throughout the length of this furnace section and is substantially constant and relatively low in the upper portion of the furnace section.

The saturated flue gases in the upper portion of the furnace section 54 exit into the duct 28 and pass into the cyclone separator(s) 26. In each separator 26, the solids are separated from the flue gases and the former passes from the separator through the dipleg 65 and is injected, via the "J" valve 66 and the conduit 68, into the inlet chamber 64. The cleaned flue gases from the separator 26 exit, via the duct 30, and pass to the heat recovery section 32 for passage through the enclosure 34 and across the reheater 36, the superheater 37, and the economizer 38, before exiting through the outlet 42 to external equipment.

Normally, the separated solids from the conduit 68 enter the inlet chamber 64 and pass, via the openings **52*a* in the partition 52 into the heat exchanger enclosure 56. Air is introduced into the section of the plenum 24 below the chambers 58 and 64 and the enclosure 56 (FIG. 1). In the enclosure 56 the air passes into the plenum sections 24*a* and 24*c* (FIG. 3) and is discharged through the corresponding nozzles 20. Thus the solids in the chambers 58 and 64 and in the compartments 56*a* and 56*c* are fluidized. The solids in the compartments 56*a* and 56*c* pass in a generally upwardly direction across the heat exchange tubes 60*a* and 60*b* in each compartment before exiting, via the openings 50*a* into the chamber 58 (FIGS. 1 and 2). The solids mix in the chamber 58 before they exit, via the lower openings 14*a* formed in the rear wall 14, back into the furnace section 54**.

The five openings **14*b* provided through the upper portion of the rear wall 14 equalize the pressure in the chamber 58 to the relatively low pressure at this elevation in the furnace section 54. Thus the fluidized solids level in chamber 58 establishes a solids head differential which drives the solids through the openings 14*a* to furnace 54**.

It is understood that a drain pipe hopper or the like may be provided on the plate 22 as needed for discharging spent solids from the furnace section 54 and the heat exchanger enclosure 56 as needed.

Feed water is introduced to and circulated through the flow circuit described above in a predetermined sequence to convert the feed water to steam and to reheat and superheat the steam. To this end, the heat removed from the solids in the heat exchanger 56 can be used to provide reheat and/or full or partial superheat. In the latter context the two groups of tubes **60*a* and 60*b* in each of the heat exchanger sections 56*a* and 56*c* can function to provide intermediate and finishing superheating, respectively, while the primary superheating is performed in the heat recovery area 32**.

Since, during the above operation, fluidizing air is not introduced into the air plenum section **24*b* associated with the heat exchanger section 56*b*. and since the opening 50*b* in the partition 50 is at a greater height than the openings 50*a*, very little, if any, flow of solids through the heat exchanger section 56*b* occurs. However, during initial start up and low load conditions the fluidizing air to the plenum section 24*b* is turned on while the air flow to the sections 24*a* and 24*c* is turned off. This allows the solids in the heat exchanger compartments 56*a* and 56*c* to slump and therefore seal this volume from further flow, while the solids from the inlet chamber 64 pass directly through the heat exchanger compartment 56*b* to the outlet chamber 58 and to the furnace section 54. Since the compartment 56*b* does not contain heat exchanger tubes, it functions as a bypass so that start up and low load operation can be achieved without exposing the heat exchanger surface 56*a* and 56*c*** to the hot recirculating solids.

Several advantages result in the system of the present invention. For example, heat is removed from the separated solids exiting from the separator 26 before they are reintroduced to the furnace section 54, without reducing the temperature of the flue gases. Also, the separated gases are at a sufficient temperature t provide significant heating of the system fluid while the recycle heat exchanger can function to provide additional heating. Also, the heat exchange efficiency in the enclosure 56 is increased and a uniform discharge of solids to the furnace is insured due to the uniform distribution and flow of the separated solids through the chambers 58 and 64 and the enclosure 56. Also the recycled solids can be passed directly from the "J" valve 66 to the furnace section during start-up or low load conditions prior to establishing adequate cooling steam flow to the enclosure compartments **56*a* and 56*c*. Also, the recycle heat exchanger enclosure 56 is formed integrally with the furnace section 54 and operates at the same saturation temperature of the cooling fluid permitting the all welded boundary wall instruction as shown in FIG. 4. Further, the recycle heat exchanger enclosure 56 is isolated from pressure fluctuations in the furnace and the solids are driven from the chamber 64 to the enclosure 56 and to the chamber 58 and the furnace section 54 by height differentials which reduces the overall power requirements. Also, a relatively large space is provided in the enclosure sections 56*a* and 56*c*** compartment for accommodating the heat exchange tubes.

It is understood that several variations may be made in the foregoing without departing from the scope of the present invention. For example, a conduit 82 (FIG. 1) can be provided in the upper portion of the partition 50 which extends into an opening formed through the rear wall 14 to equalize the pressure in the chamber 58 to the relatively lower pressure in the furnace section 54. Thus the conduit can be used in addition to, or in place of, the openings **14*b* in the rear wall 14**. Also, the heat removed from the solids in the recycle heat exchanger enclosure can be used for heating the system fluid in the furnace section or the economizer, etc. Also, other types of beds may be utilized in the furnace such as a circulating transport mode bed with constant density through its entire height or a bubbling bed, etc. Also a series heat recovery arrangement can be provided with superheat, reheat and/or economizer surface, or any combination thereto. Further, the number and/or location of the bypass channels in the recycle heat exchanger can be varied.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion system comprising an enclosure; means defining a furnace section and a recycle heat exchange section in said enclosure; a fluidized bed formed in each of said sections; a separating section for receiving a mixture of flue gases and entrained particulate material from the fluidized bed in said furnace section and separating said entrained particulate material from said flue gases; a heat recovery section for receiving said separated flue gases; means for passing said separated material from said separating section to said recycle heat exchange section; means for dividing said recycle heat exchange section into an inlet chamber for receiving said separated material from said passing means, an outlet chamber, a bypass compartment extending between said chambers, and an additional compartment extending between said chambers; heat exchange means disposed in said additional compartment for removing heat from said separated material; means for selectively directing said separated material from said inlet chamber, through said additional compartment to said outlet chamber or from said inlet chamber, through said bypass compartment to said outlet chamber and means connecting said outlet chamber to said furnace section for passing said separated material to said furnace section.

2. The system of claim 1 wherein said inlet chamber extends between said passing means and said compartments and said outlet chamber extends between said compartments, and said furnace section.

3. The system of claim 1 wherein said directing means comprises means connecting said inlet chamber to said compartments, means connecting said compartments to said outlet chamber, and means connecting said outlet chamber to said furnace section.

4. The system of claim 3 wherein said dividing means comprises a plurality of partitions disposed in said enclosure.

5. The system of claim 4 wherein said connecting means comprises openings formed through said partitions.

6. The system of claim 1 wherein said directing means comprises means responsive to start-up and low load conditions for passing said separated material through said bypass compartment and means responsive to full-load conditions for passing said separated material through said additional compartment.

7. The system of claim 1 wherein said directing means comprises means for selectively introducing air to said bypass compartment or to said additional compartment to fluidize the separated material therein to permit the flow of said separated material through said bypass compartment or through said additional compartment, respectively.

8. The system of claim 1 further comprising means for introducing air into at least one of said chambers to fluidize the separated material in said chambers.

9. The system of claim 1 wherein at least a portion of the walls of said enclosure are formed by tubes, and further comprising fluid flow circuit means for passing fluid through said tubes to transfer heat generated in said furnace section to said fluid.

10. The system of claim 9 wherein said flow circuit means further comprises means for passing said fluid through said heat exchange means in a heat exchange relation to the material in the fluidized bed in said recycle heat exchange section to transfer heat from said separated material in said recycle heat exchange section to said fluid to control the temperature of the separated material.

11. The system of claim 1, wherein the separated material in said compartments seals against the backflow of material from said furnace section to said separating section.

12. The system of claim 1 further comprises means for equalizing the pressure in said furnace section and said heat exchange section.

13. The system of claim 12 wherein said dividing means comprises a plurality of partitions disposed in said enclosure and wherein said pressure equalizing means comprises openings formed through the partition extending between said furnace section and said outlet compartment.

14. A fluidized bed combustion method comprising the steps of forming a furnace section and a recycle heat exchange section in an enclosure, fluidizing a bed of combustible material in said furnace section, discharging a mixture of fluid gases and entrained material from said furnace section, separating said entrained material from said flue gases, passing said separated flue gases to a heat recovery section, passing said separated material into said recycle heat exchange section, responding to full-load conditions for removing heat from said separated material in said recycle heat exchange section and then passing said material from said recycle heat exchange section to said furnace section, and responding to start-up and/or low-load conditions for passing said separated material directly through said recycle heat exchange section to said furnace section without removing heat from said separated material.

15. The method of claim 14 further comprising the step of passing said separated material through an outlet chamber in said recycle heat exchange section before the separated material is passed to said furnace section.

16. The method of claim 14 further comprising the step of equalizing the pressure in said furnace section and said recycle heat exchange section.

17. The method of claim 14 further comprising the step of fluidizing said separated material in a portion of said recycle heat exchange section.

18. The method of claim 14 further comprising the steps of establishing a fluid flow circuit including said recycle heat exchange section and water tubes forming at least a portion of the walls of said furnace section and said recycle heat exchange section, and passing fluid through said circuit to absorb heat from said furnace section and said recycle heat exchange section.

19. The method of claim 18 wherein said fluid is superheated as it passes through said recycle heat exchange section.

20. A fluidized bed combustion system comprising an enclosure; means defining in said enclosure a furnace section, a recycle heat exchange section and a return section extending between said furnace section and said recycle heat exchange section; a fluidized bed formed in each of said sections; a separating section for receiving a mixture of flue gases and entrained particulate material from the fluidized bed in said furnace section and separating said entrained particulate material from said flue gases; a heat recovery section for receiving said separated flue gases; means for passing said separated material from said separating section to said recycle heat exchange section; means connecting said recycle heat exchange section to said return section and said return section to said furnace section for passing said separated material to said furnace section, and means for equalizing the pressure in said furnace section, said return section and said heat exchange section.

21. The system of claim 20 further comprising heat exchange means disposed in said recycle heat exchange section for removing heat from said separated material.

22. The system of claim 20 wherein said defining means comprises partition means disposed in said enclosure.

23. The system of claim 22 wherein said equalizing means comprises openings formed through said partition means.

24. The system of claim 20 wherein said equalizing means comprises a conduit connecting said recycle heat exchange section to said furnace section.

25. The system of claim 22 wherein said connecting means comprises openings formed through said partition means.

26. The system of claim 25 wherein said equalizing means comprises additional openings formed through said partition means.

27. The system of claim 20 further comprising means for introducing air into said sections to fluidize the separated material in said sections.

28. The system of claim 20 wherein at least a portion of the walls of said enclosure are formed by tubes, and further comprising fluid flow circuit means for passing fluid through said tubes to transfer heat generated in said furnace section to said fluid.

29. The system of claim 28 wherein said flow circuit means further comprises means for passing said fluid through said heat exchange means in a heat exchange relation to the material in the fluidized bed in said recycle heat exchange section to transfer heat from said separated material in said recycle heat exchange section to said fluid to control the temperature of the separated material.

30. The system of claim 20, wherein the separated material in said recycle heat exchange section seals against the backflow of material from said furnace section to said separating section.

31. A fluidized bed combustion method comprising the steps for forming a furnace section and a recycle heat exchange section in an enclosure, fluidizing a bed of combustible material in said furnace section, discharging a mixture of flue gases and entrained material from said furnace section, separating said entrained material from said flue gases, passing said separated flue gases to a heat recovery section, passing said separated material into said recycle heat exchange section, equalizing the pressure between said recycle heat exchange section and said furnace section, and passing said separated material from said recycle heat exchange section to said furnace section.

32. The method of claim 31 further comprising the step of removing heat from said separated material in said recycle heat exchange section.

33. The method of claim 31 further comprising the step of passing said separated material through an outlet chamber in said recycle heat exchange section before the separated material is passed to said furnace section.

34. The method of claim 31 further comprising the step of fluidizing said separated material in a portion of said recycle heat exchange section.

35. The method of claim 31 further comprising the steps of establishing a fluid flow circuit including said recycle heat exchange section and water tubes forming at least a portion of the walls of said furnace section and said recycle heat exchange section, and passing fluid through said circuit to absorb heat from said furnace section and said recycle heat exchange section.

* * * * *